US011069312B2

(12) United States Patent
Watanabe

(10) Patent No.: US 11,069,312 B2
(45) **Date of Patent: *Jul. 20, 2021**

(54) ELECTRONIC DEVICE, DISPLAY DEVICE AND DISPLAY CONTROL METHOD

(71) Applicant: Japan Display Inc., Minato-ku (JP)

(72) Inventor: Yoshihiro Watanabe, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/895,593

(22) Filed: Jun. 8, 2020

(65) Prior Publication Data

US 2020/0302883 A1 Sep. 24, 2020

Related U.S. Application Data

(63) Continuation of application No. 16/109,999, filed on Aug. 23, 2018, now Pat. No. 10,714,036.

(30) Foreign Application Priority Data

Aug. 24, 2017 (JP) ..... JP2017-161439

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 2320/0252* (2013.01); *G09G 2320/0285* (2013.01); *G09G 2320/064* (2013.01); *G09G 2320/0646* (2013.01); *G09G 2340/02* (2013.01); *G09G 2340/16* (2013.01)

(58) Field of Classification Search
CPC ... G09G 2320/0252; G09G 2320/0285; G09G 2320/064; G09G 2320/0646; G09G 2340/02; G09G 2340/16; G09G 3/3406; G09G 3/3607
See application file for complete search history.

(56) References Cited

U.S. PATENT DOCUMENTS 10,714,036 B2 * 7/2020 Watanabe ..... G09G 3/3607
2001/0019390 A1 * 9/2001 Itoh ..... G02F 1/1393 349/130
2005/0111237 A1 * 5/2005 Moon ..... G02F 1/133604 362/561
2006/0103615 A1 * 5/2006 Shih ..... G09G 3/3648 345/88

(Continued)

FOREIGN PATENT DOCUMENTS

JP 2006-157775 A 6/2006
JP 2009-109736 A 5/2009
JP 2010-091782 A 4/2010

OTHER PUBLICATIONS

Office Action dated May 18, 2021, in Japanese Patent Application No. 2017-161439 (Machine Translation).

*Primary Examiner* — Dmitriy Bolotin
(74) *Attorney, Agent, or Firm* — Oblon, McClelland, Maier & Neustadt, L.L.P.

(57) ABSTRACT

According to one embodiment, an electronic device includes a display panel having a plurality of pixels arranged in a matrix. Gray levels of the pixels are determined according to a gray level of a first frame, a gray level of a second frame and positions of the pixels in the matrix.

9 Claims, 12 Drawing Sheets

Look-up table $LUT_0$ (Scanning line $LP_0$)

| | | Gray-level of video signal of current frame | | | | | | | | | | | | | | | | |
|---|---|---|---|---|---|---|---|---|---|---|---|---|---|---|---|---|---|---|
| | | 0 | ··· | 32 | ··· | 64 | ··· | 96 | ··· | 128 | ··· | 160 | ··· | 192 | ··· | 224 | ··· | 255 |
| Gray level of (post-correction) video signal of previous frame | 0 | 0 | ··· | 33 | ··· | 71 | ··· | 106 | ··· | 139 | ··· | 169 | ··· | 198 | ··· | 228 | ··· | 255 |
| | ··· | ··· | ··· | ··· | ··· | ··· | ··· | ··· | ··· | ··· | ··· | ··· | ··· | ··· | ··· | ··· | ··· | ··· |
| | 32 | 0 | ··· | 32 | ··· | 67 | ··· | 104 | ··· | 137 | ··· | 168 | ··· | 198 | ··· | 227 | ··· | 255 |
| | ··· | ··· | ··· | ··· | ··· | ··· | ··· | ··· | ··· | ··· | ··· | ··· | ··· | ··· | ··· | ··· | ··· | ··· |
| | 64 | 0 | ··· | 32 | ··· | 64 | ··· | 100 | ··· | 134 | ··· | 165 | ··· | 196 | ··· | 226 | ··· | 255 |
| | ··· | ··· | ··· | ··· | ··· | ··· | ··· | ··· | ··· | ··· | ··· | ··· | ··· | ··· | ··· | ··· | ··· | ··· |
| | 96 | 0 | ··· | 32 | ··· | 64 | ··· | 96 | ··· | 130 | ··· | 163 | ··· | 195 | ··· | 226 | ··· | 255 |
| | ··· | ··· | ··· | ··· | ··· | ··· | ··· | ··· | ··· | ··· | ··· | ··· | ··· | ··· | ··· | ··· | ··· | ··· |
| | 128 | 0 | ··· | 31 | ··· | 64 | ··· | 96 | ··· | 128 | ··· | 161 | ··· | 193 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 160 | 0 | ··· | 30 | ··· | 63 | ··· | 96 | ··· | 128 | ··· | 160 | ··· | 192 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 192 | 0 | ··· | 28 | ··· | 62 | ··· | 95 | ··· | 128 | ··· | 160 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 224 | 0 | ··· | 19 | ··· | 59 | ··· | 93 | ··· | 127 | ··· | 160 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 255 | 0 | ··· | 0 | ··· | 55 | ··· | 91 | ··· | 125 | ··· | 158 | ··· | 191 | ··· | 224 | ··· | 255 |

(56) References Cited

U.S. PATENT DOCUMENTS

| | | | | |
|---|---|---|---|---|
| 2007/0035706 | A1* | 2/2007 | Margulis | G09G 3/342 353/122 |
| 2007/0091042 | A1* | 4/2007 | Chung | G09G 3/3648 345/88 |
| 2007/0296354 | A1* | 12/2007 | Okabe | G09G 3/3426 315/307 |
| 2009/0085856 | A1* | 4/2009 | Okada | G09G 3/3648 345/94 |
| 2010/0165222 | A1 | 7/2010 | Choi | |
| 2010/0309192 | A1* | 12/2010 | Chao | G09G 3/3648 345/214 |
| 2013/0070005 | A1 | 3/2013 | Tokumura et al. | |
| 2015/0109286 | A1* | 4/2015 | Verbeure | G09G 3/36 345/419 |
| 2017/0243319 | A1* | 8/2017 | Wittenbrink | G02B 27/0093 |
| 2017/0287408 | A1* | 10/2017 | Shi | G02B 27/017 |
| 2017/0309245 | A1* | 10/2017 | Richards | G09G 3/001 |
| 2018/0188803 | A1* | 7/2018 | Sharma | G09G 5/10 |
| 2018/0240424 | A1* | 8/2018 | Aoki | G09G 3/3677 |

* cited by examiner

FIG. 10

Look-up table $LUT_0$ (Scanning line $LP_0$)

| | | Gray-level of video signal of current frame | | | | | | | | | | | | | | | | |
|---|---|---|---|---|---|---|---|---|---|---|---|---|---|---|---|---|---|---|
| | | 0 | ··· | 32 | ··· | 64 | ··· | 96 | ··· | 128 | ··· | 160 | ··· | 192 | ··· | 224 | ··· | 255 |
| Gray level of (post-correction) video signal of previous frame | 0 | 0 | ··· | 33 | ··· | 71 | ··· | 106 | ··· | 139 | ··· | 169 | ··· | 198 | ··· | 228 | ··· | 255 |
| | ··· | ··· | ··· | ··· | ··· | ··· | ··· | ··· | ··· | ··· | ··· | ··· | ··· | ··· | ··· | ··· | ··· | ··· |
| | 32 | 0 | ··· | 32 | ··· | 67 | ··· | 104 | ··· | 137 | ··· | 168 | ··· | 198 | ··· | 227 | ··· | 255 |
| | ··· | ··· | ··· | ··· | ··· | ··· | ··· | ··· | ··· | ··· | ··· | ··· | ··· | ··· | ··· | ··· | ··· | ··· |
| | 64 | 0 | ··· | 32 | ··· | 64 | ··· | 100 | ··· | 134 | ··· | 165 | ··· | 196 | ··· | 226 | ··· | 255 |
| | ··· | ··· | ··· | ··· | ··· | ··· | ··· | ··· | ··· | ··· | ··· | ··· | ··· | ··· | ··· | ··· | ··· | ··· |
| | 96 | 0 | ··· | 32 | ··· | 64 | ··· | 96 | ··· | 130 | ··· | 163 | ··· | 195 | ··· | 226 | ··· | 255 |
| | ··· | ··· | ··· | ··· | ··· | ··· | ··· | ··· | ··· | ··· | ··· | ··· | ··· | ··· | ··· | ··· | ··· | ··· |
| | 128 | 0 | ··· | 31 | ··· | 64 | ··· | 96 | ··· | 128 | ··· | 161 | ··· | 193 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 160 | 0 | ··· | 30 | ··· | 63 | ··· | 96 | ··· | 128 | ··· | 160 | ··· | 192 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 192 | 0 | ··· | 28 | ··· | 62 | ··· | 95 | ··· | 128 | ··· | 160 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 224 | 0 | ··· | 19 | ··· | 59 | ··· | 93 | ··· | 127 | ··· | 160 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 255 | 0 | ··· | 0 | ··· | 55 | ··· | 91 | ··· | 125 | ··· | 158 | ··· | 191 | ··· | 224 | ··· | 255 |

FIG. 11

Look-up table $LUT_1$ (Scanning line $LP_1$)

| | | Gray-level of video signal of current frame | | | | | | | | | | | | | | | | |
|---|---|---|---|---|---|---|---|---|---|---|---|---|---|---|---|---|---|---|
| | | 0 | ··· | 32 | ··· | 64 | ··· | 96 | ··· | 128 | ··· | 160 | ··· | 192 | ··· | 224 | ··· | 255 |
| Gray level of (post-correction) video signal of previous frame | 0 | 0 | ··· | 34 | ··· | 72 | ··· | 108 | ··· | 141 | ··· | 170 | ··· | 199 | ··· | 228 | ··· | 255 |
| | ··· | ··· | ··· | ··· | ··· | ··· | ··· | ··· | ··· | ··· | ··· | ··· | ··· | ··· | ··· | ··· | ··· | ··· |
| | 32 | 0 | ··· | 32 | ··· | 68 | ··· | 105 | ··· | 139 | ··· | 169 | ··· | 198 | ··· | 228 | ··· | 255 |
| | ··· | ··· | ··· | ··· | ··· | ··· | ··· | ··· | ··· | ··· | ··· | ··· | ··· | ··· | ··· | ··· | ··· | ··· |
| | 64 | 0 | ··· | 32 | ··· | 64 | ··· | 100 | ··· | 135 | ··· | 166 | ··· | 197 | ··· | 227 | ··· | 255 |
| | ··· | ··· | ··· | ··· | ··· | ··· | ··· | ··· | ··· | ··· | ··· | ··· | ··· | ··· | ··· | ··· | ··· | ··· |
| | 96 | 0 | ··· | 31 | ··· | 64 | ··· | 96 | ··· | 130 | ··· | 163 | ··· | 195 | ··· | 226 | ··· | 255 |
| | ··· | ··· | ··· | ··· | ··· | ··· | ··· | ··· | ··· | ··· | ··· | ··· | ··· | ··· | ··· | ··· | ··· | ··· |
| | 128 | 0 | ··· | 31 | ··· | 64 | ··· | 96 | ··· | 128 | ··· | 161 | ··· | 194 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 160 | 0 | ··· | 29 | ··· | 63 | ··· | 96 | ··· | 128 | ··· | 160 | ··· | 192 | ··· | 225 | ··· | 255 |
| | ··· | ··· | ··· | ··· | ··· | ··· | ··· | ··· | ··· | ··· | ··· | ··· | ··· | ··· | ··· | ··· | ··· | ··· |
| | 192 | 0 | ··· | 26 | ··· | 62 | ··· | 95 | ··· | 128 | ··· | 160 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 224 | 0 | ··· | 13 | ··· | 58 | ··· | 93 | ··· | 126 | ··· | 159 | ··· | 192 | ··· | 224 | ··· | 255 |
| | ··· | ··· | ··· | ··· | ··· | ··· | ··· | ··· | ··· | ··· | ··· | ··· | ··· | ··· | ··· | ··· | ··· | ··· |
| | 255 | 0 | ··· | 0 | ··· | 52 | ··· | 89 | ··· | 124 | ··· | 158 | ··· | 191 | ··· | 224 | ··· | 255 |

FIG. 12

Look-up table $LUT_0$ (Scanning line $LP_0$)

| | | Gray-level of video signal of current frame | | | | | | | | | | | | | | | | |
|---|---|---|---|---|---|---|---|---|---|---|---|---|---|---|---|---|---|---|
| | | 0 | ··· | 32 | ··· | 64 | ··· | 96 | ··· | 128 | ··· | 160 | ··· | 192 | ··· | 224 | ··· | 255 |
| Gray level of (post-correction) video signal of previous frame | 0 | 0 | ··· | 1 | ··· | 7 | ··· | 10 | ··· | 11 | ··· | 9 | ··· | 6 | ··· | 4 | ··· | 0 |
| | ··· | ··· | ··· | ··· | ··· | ··· | ··· | ··· | ··· | ··· | ··· | ··· | ··· | ··· | ··· | ··· | ··· | ··· |
| | 32 | 0 | ··· | 0 | ··· | 3 | ··· | 8 | ··· | 9 | ··· | 8 | ··· | 6 | ··· | 3 | ··· | 0 |
| | ··· | ··· | ··· | ··· | ··· | ··· | ··· | ··· | ··· | ··· | ··· | ··· | ··· | ··· | ··· | ··· | ··· | ··· |
| | 64 | 0 | ··· | 0 | ··· | 0 | ··· | 4 | ··· | 6 | ··· | 5 | ··· | 4 | ··· | 2 | ··· | 0 |
| | ··· | ··· | ··· | ··· | ··· | ··· | ··· | ··· | ··· | ··· | ··· | ··· | ··· | ··· | ··· | ··· | ··· | ··· |
| | 96 | 0 | ··· | 0 | ··· | 0 | ··· | 0 | ··· | 2 | ··· | 3 | ··· | 3 | ··· | 2 | ··· | 0 |
| | ··· | ··· | ··· | ··· | ··· | ··· | ··· | ··· | ··· | ··· | ··· | ··· | ··· | ··· | ··· | ··· | ··· | ··· |
| | 128 | 0 | ··· | -1 | ··· | 0 | ··· | 0 | ··· | 0 | ··· | 1 | ··· | 1 | ··· | 1 | ··· | 0 |
| | ··· | ··· | ··· | ··· | ··· | ··· | ··· | ··· | ··· | ··· | ··· | ··· | ··· | ··· | ··· | ··· | ··· | ··· |
| | 160 | 0 | ··· | -2 | ··· | -1 | ··· | 0 | ··· | 0 | ··· | 0 | ··· | 0 | ··· | 1 | ··· | 0 |
| | ··· | ··· | ··· | ··· | ··· | ··· | ··· | ··· | ··· | ··· | ··· | ··· | ··· | ··· | ··· | ··· | ··· | ··· |
| | 192 | 0 | ··· | -4 | ··· | -2 | ··· | -1 | ··· | 0 | ··· | 0 | ··· | 0 | ··· | 0 | ··· | 0 |
| | ··· | ··· | ··· | ··· | ··· | ··· | ··· | ··· | ··· | ··· | ··· | ··· | ··· | ··· | ··· | ··· | ··· | ··· |
| | 224 | 0 | ··· | -13 | ··· | -5 | ··· | -3 | ··· | -1 | ··· | 0 | ··· | 0 | ··· | 0 | ··· | 0 |
| | ··· | ··· | ··· | ··· | ··· | ··· | ··· | ··· | ··· | ··· | ··· | ··· | ··· | ··· | ··· | ··· | ··· | ··· |
| | 255 | 0 | ··· | 0 | ··· | -9 | ··· | -5 | ··· | -3 | ··· | -2 | ··· | -1 | ··· | 0 | ··· | 0 |

ELECTRONIC DEVICE, DISPLAY DEVICE AND DISPLAY CONTROL METHOD

CROSS-REFERENCE TO RELATED APPLICATIONS

This application is a continuation of U.S. application Ser. No. 16/109,999 filed Aug. 23, 2018, and which is based upon and claims the benefit of priority from Japanese Patent Application No. 2017-161439, filed Aug. 24, 2017, the entire contents of all of which are incorporated herein by reference.

FIELD

Embodiments described herein relate generally to an electronic device, a display device and a display control method.

BACKGROUND

One example of a display device is a liquid crystal display device. In a liquid crystal display device, it takes liquid crystal a relatively long time to respond to an input of a video signal. If the response speed of a display device is slow, an image cannot be displayed in an input tone. To improve the response speed of liquid crystal, a liquid crystal display device adopts overdrive. Overdrive is, when a voltage which drives liquid crystal is to be changed, to make the voltage change drastic. For example, a higher voltage is applied when a voltage is to be increased, and a lower voltage is applied when a voltage is to be reduced. That is, overdrive aims to display an image having an original luminance at high speed by correcting the gray level of a video signal of the current frame to be displayed based on the difference between the gray level of the video signal of the current frame and the gray level of a video signal of the previous frame.

BRIEF DESCRIPTION OF THE DRAWINGS

FIG. 10 shows an example of a look-up table $LUT_0$.

FIG. 11 shows an example of a look-up table $LUT_1$.

FIG. 12 shows an example of a look-up table $LUT_2$.

DETAILED DESCRIPTION

Figure 1:
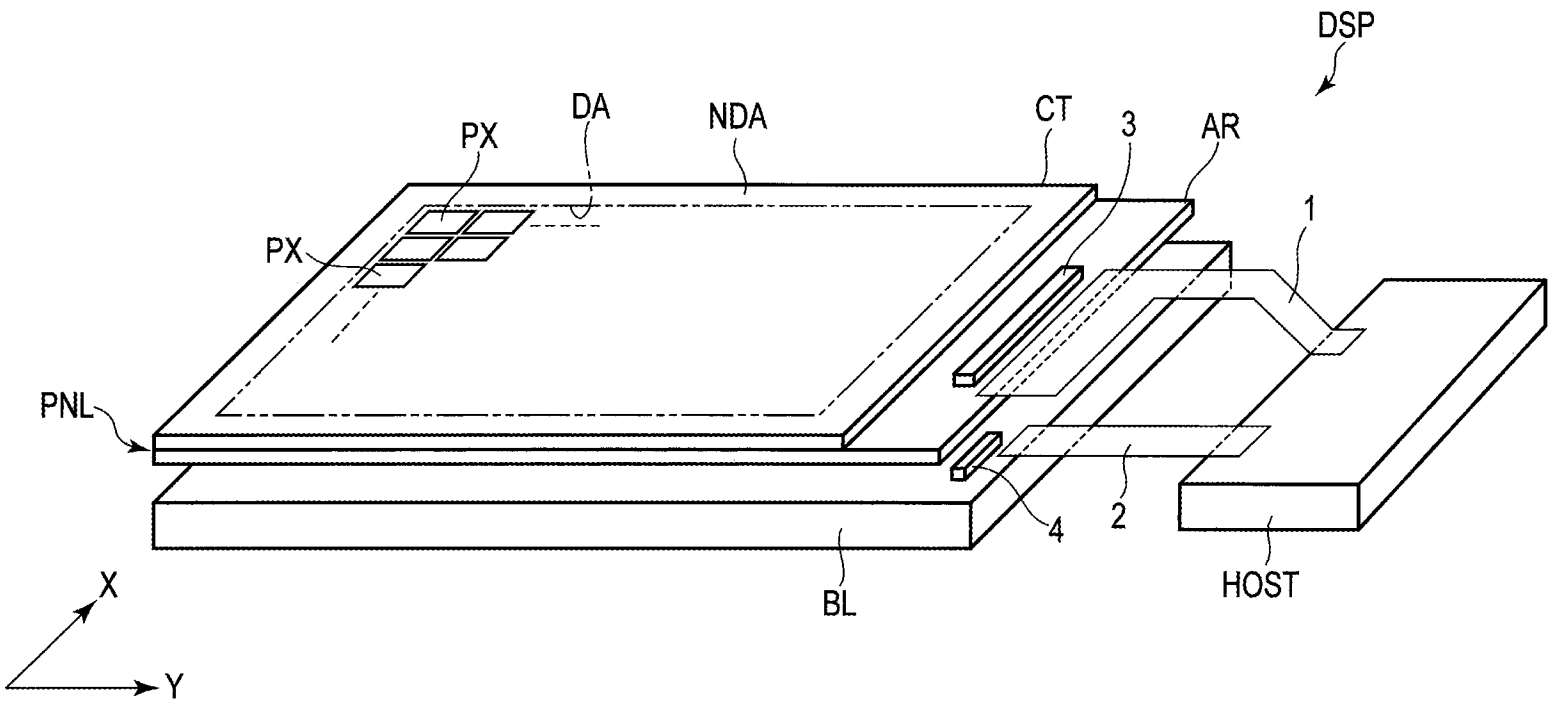
FIG. 1 is a perspective view showing a configuration example of a liquid crystal display device as an example of a display device according to an embodiment.

Various embodiments will be described hereinafter with reference to the accompanying drawings. The disclosure is merely an example, and an invention is not limited by the content described in the following embodiment. Modifications which are easily conceivable by a person of ordinary skill in the art come within the scope of the disclosure as a matter of source. To make the description clearer, the sizes, shapes and the like of the respective parts are illustrated schematically in the drawings, rather than as an accurate representation of what is implemented. In the drawings, the corresponding elements are denoted by the same reference numbers, and detailed description thereof is omitted unless necessary.

In general, according to one embodiment, an electronic device includes a display panel having a plurality of pixels arranged in a matrix. Gray levels of the pixels are determined according to a gray level of a first frame, a gray level of a second frame and positions of the pixels in the matrix.

[General Structure]

FIG. 1 is a perspective view showing a configuration example of a liquid crystal display device as an example of a display device of an embodiment. The example of the display device is not limited to a liquid crystal display device and may be an organic EL display device, etc. Recently, the display device is used in an electronic device which displays a virtual space on a screen and performs VR display. VR display is often performed by head-mounted displays. The head-mounted displays include those which include displays designed for exclusive use and those which are equipped with smartphones and use the display screens of the smartphones. Response speed is an important feature to all displays and is a particularly important feature to displays which perform VR display. If the response speed of VR display is slow, the screen cannot follow the move of the eyes of the viewer, and the viewer feels uncomfortable as if the viewer suffers from motion sickness. The embodiment aims to perform appropriate overdrive to improve the response speed.

A liquid crystal display device DSP includes a display panel PNL which is, for example, an active-matrix display panel, a display driver 3 which drives the display panel PNL, a backlight unit BL which illuminates the display panel PNL, a light source driver 4 which drives the backlight unit BL, flexible substrates 1 and 2, and the like. The liquid crystal display device DSP is connected to a host device HOST via the flexible substrates 1 and 2. The display driver 3 and the light source driver 4 may be independently composed of IC chips or may be integrally composed of one IC chip. A first direction X along one of the short sides of the display panel PNL and a second direction Y along one of the long sides of the display panel PNL orthogonally intersect each other in the example illustrated, but the first direction X and the second direction Y may intersect each other at an angle other than 90°.

The display panel PNL includes an array substrate AR which is formed of glass or resin, and a counter-substrate CT which is opposed to the array substrate AR and is also formed of glass or resin. A liquid crystal layer (not shown in FIG. 1) as a display layer is arranged between the array substrate AR and the counter-substrate CT. The display panel PNL includes a display area DA which displays an image and a frame-shaped non-display area NDA which surrounds the display area DA. A two-dimensional array (matrix) of pixels PX in the first direction X and the second direction Y is provided in the display area DA of the array substrate AR. The display panel PNL is viewed from the counter-substrate CT side. Therefore, the counter-substrate CT is referred to also as an upper substrate and the array substrate AR is referred to also as a lower substrate.

The backlight unit BL as a light source is arranged on the rear surface of the array substrate AR. The light source includes a light-emitting diode (LED). The backlight unit BL takes various forms such as an illumination device which uses a light-guide arranged on the rear surface side of the display panel PNL and an LED arranged on the side surface side of the light-guide or an illumination device which uses a point light source in which light-emitting elements are arranged in a plane on the rear surface side of the display panel PNL.

The light source is not limited to a backlight and may be a front light arranged on the display surface side of the display panel PNL.

The display driver 3 is mounted on the array substrate AR. The flexible substrate 1 connects the display panel PNL (array substrate AR) and the host device HOST. The flexible substrate SUB2 connects the backlight unit BL and the host device HOST. The light source driver 4 is mounted on the backlight unit BL but may be incorporated into the host device HOST or the display driver 3. In the case of incorporating the light source driver 4 into the display driver 3, the flexible substrate 2 may be connected to the flexible substrate 1 or the display panel PNL.

Backlight drive methods include a hold method in which the backlight unit BL emits light at a constant luminance in one frame, and an impulse method in which the backlight unit BL emits light in a part of one frame period and does not emit light in the rest of one frame period. In the hold method, a backlight is lighting even before liquid crystal displays an image, and therefore an image is displayed in a transitional state of liquid crystal in the middle of response. Accordingly, when a moving image is displayed, the edges of the image may become blurry or the motion of the image may become unnatural. Particularly, in the case of VR display, an excellent quality image cannot be displayed by the hold method. In the impulse method, problems associated with the hold method will be solved by lighting a backlight after liquid crystal fully responds to a video signal. The impulse method is applied to the embodiment, but the hold method may be applied in some cases. Either one of the impulse method and the hold method may be selected by the user. More specifically, a timing signal and a backlight drive mode designation signal are input from the host device HOST to the light source driver 4, and the light source driver 4 drives the backlight unit BL with timing according to the timing signal and the designation signal. In the case of a smartphone, the hold method may be applied for normal usage, and the impulse method may be applied for usage as a head-mounted display.

The liquid crystal display device DSP configured as described above is the so-called transmissive liquid crystal display device which displays an image by selectively transmitting/blocking light entering the display panel PNL from the backlight unit BL through/by each of the pixels PX according to a video signal from the host device HOST. The liquid crystal display device DSP may be a reflective liquid crystal display device which displays an image by selectively reflecting/non-reflecting light entering the liquid crystal display panel PNL from the display surface side by each of the pixels PX, or may be a semi-transmissive liquid crystal display device which has both the function of the transmissive liquid crystal display device and the function of the reflective liquid crystal display device. The host device HOST supplies, to the liquid crystal display device DSP, a video signal corresponding to a video downloaded from the Internet, an image shot by a camera which is not shown in the drawing, or a video generated by an application such as an application which displays VR content.

[Display Panel PNL]

Figure 2:
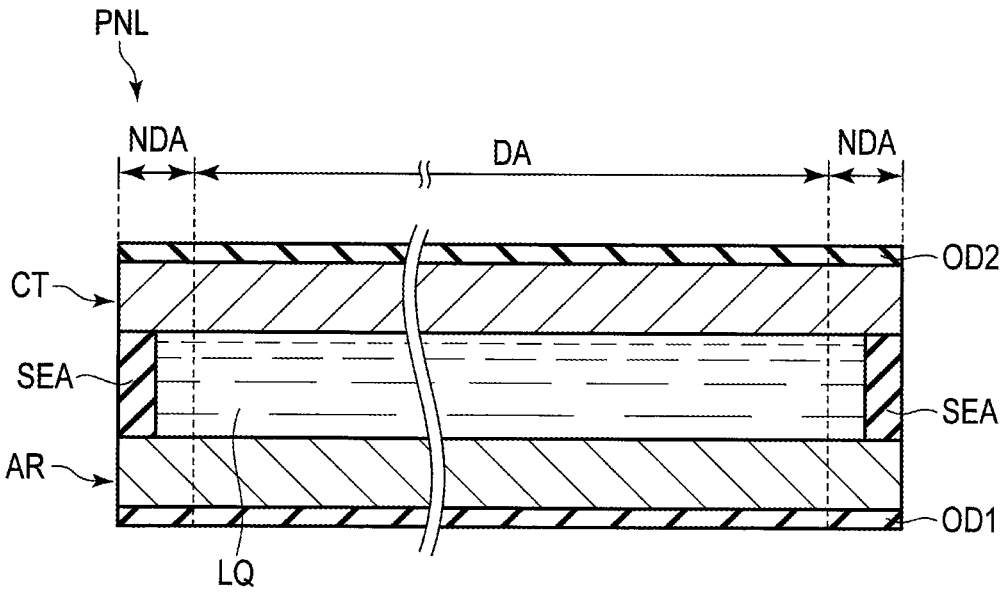
FIG. 2 is a sectional view showing an example of a display panel PNL.

FIG. 2 is a sectional view showing an example of the display panel PNL.

The display panel PNL includes the array substrate AR, the counter-substrate CT, a liquid crystal layer LQ, a sealant SEA, a first optical element OD1, a second optical element OD2, and the like. Although not shown in the drawing, color filters are provided on one of the array substrate AR and the counter-substrate CT. For example, the color filter includes red (R), green (G) and blue (B) filter elements. Each of the color filters corresponds to a sub-pixel, and the sub-pixels of three colors R, G and B constitute one pixel. A sub-pixel of white (W) may be included as the sub-pixels constituting one pixel.

The sealant SEA is arranged in the non-display area NDA and attaches the array substrate AR and the counter-substrate CT to each other. The liquid crystal layer LQ is held between the array substrate AR and the counter-substrate CT. The first optical element OD1 is arranged on a side opposite to a surface of the array substrate AR which contacts the liquid crystal layer LQ. The second optical element OD2 is arranged on a side opposite to a surface of the counter-substrate CT which contacts the liquid crystal layer LQ. The first optical element OD1 and the second optical element OD2 include polarizers, respectively. The first optical element OD1 and the second optical element OD2 may include other optical elements such as phase difference plate films.

Figure 3:
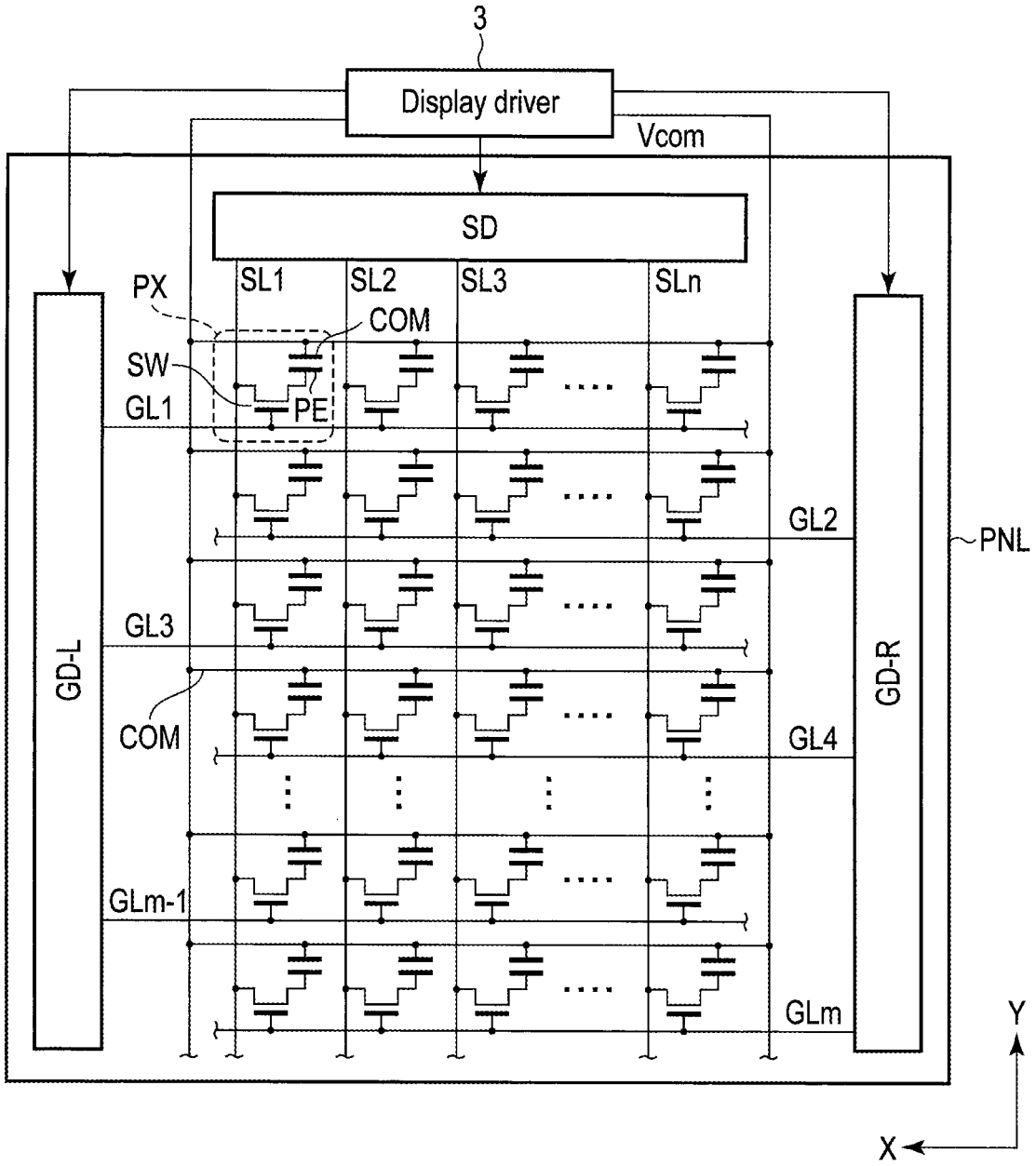
FIG. 3 is a plan view showing an example of an electrical configuration of the display panel PNL.

FIG. 3 is a plan view showing an example of the electrical configuration of the display panel PNL.

The display panel PNL has scanning lines GL (GL1, GL2, . . . GLm), signal lines SL (SL1, SL2, . . . SLn), pixel switches SW, pixel electrodes PE, common electrodes (counter-electrodes) COM, gate drivers (scanning line drive circuits) GD (GD-R and GD-L), a source driver (signal line drive circuit) SD, and the like. The scanning lines GL, the signal lines SL, the pixel switches SW, the pixel electrodes PE, the gate drivers GD and the source driver SD are provided on the array substrate AR. The liquid crystal display panel PNL according to the present embodiment has a configuration corresponding to a fringe field switching (FFS) mode which is a type of in-plane switching (IPS) mode which drives liquid crystal by a lateral electric field substantially parallel to the main surfaces of the substrates. Therefore, the common electrodes COM are provided on the array substrate AR. The display panel PNL may have a configuration corresponding to a display mode different from the FFS mode instead. For example, the display panel PNL may have a configuration corresponding to a mode which mainly uses a longitudinal electric field substantially perpendicular to the main surfaces of the substrates, as a vertical alignment (VA) mode. In the display mode using the longitudinal electric field, the common electrode COM is not provided on the array substrate AR but is provided on the counter-substrate CT.

The scanning line GL extends in the first direction X. The signal line SL extends in the second direction Y. The pixel switch SW is arranged close to the position of the intersection of the scanning line GL and the signal line SL.

The pixel switch SW is a thin-film transistor (TFT). The first electrode of the pixel switch SW is electrically connected to the corresponding scanning line GL. The second electrode of the pixel switch SW is electrically connected to the corresponding signal line SL. The third electrode of the pixel switch SW is electrically connected to the corresponding pixel electrode PE. The first electrode functions as a gate electrode, one of the second electrode and the third electrode functions as a source electrode, and the other one of the second electrode and the third electrode functions as a drain electrode.

The display driver 3 connected to the host device HOST supplies a video signal to the source driver SD, supplies a timing signal to the gate drivers GD-R and GD-L, and supplies a common voltage Vcom to the pixels PX. The scanning lines GL are electrically connected to the output terminals of the gate drivers GD-R and GD-L. The odd-numbered scanning lines GL are connected to the gate driver GD-L, and the even-numbered scanning lines GL are connected to the gate driver GD-R. The signal lines SL are electrically connected to the output terminals of the source driver SD. The gate drivers GD and the source driver SD function as drivers which drive the pixels PX. The gate drivers GD-R and GD-L may not be arranged on both the right side and the left side of the array of the pixels PX, but a single gate driver GD may be arranged on one of the right side and the left side of the array of the pixels PX and all the scanning lines GL may be connected to the single one gate driver GD.

The gate drivers GD and the source driver SD are arranged in the non-display area NDA. The gate drivers GD sequentially apply an on-state voltage of the pixel switch SW to the scanning lines GL. When the scanning line GL is supplied with the on-state voltage (or selected), the source electrode and the drain electrode of the pixel switches SW electrically connected to the scanning line GL become electrically connected to each other. The source driver SD supplies corresponding video signals to the signal lines SL. The signal supplied to the signal line SL is applied to the corresponding pixel electrode PE via the pixel switch SW in which the source electrode and the drain electrode are electrically connected to each other. The luminance of the pixel PX can be thereby changed. The source driver SD and the display driver 3 may be integrally formed on one semiconductor chip.

[Pixels PX]

Figure 4:
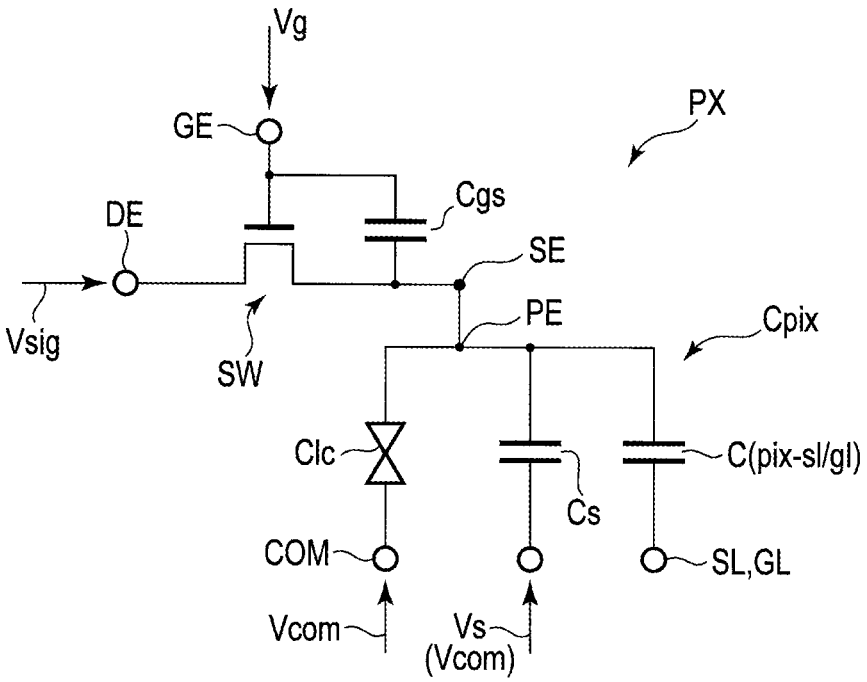
FIG. 4 shows an example of the equivalent circuit of each of pixels PX shown in FIG. 3.

All the pixels PX have the same configuration, and FIG. 4 shows an example of the equivalent circuit of each of the pixels PX shown in FIG. 3.

The first electrode of the pixel switch SW is a gate electrode GE, and the second electrode of the pixel switch SW is a drain electrode DE, and the third electrode of the pixel switch SW is a source electrode SE. A video signal Vsig is supplied to the drain electrode DE via the signal line SL, etc. A control signal Vg is supplied to the gate electrode GE via the scanning line GL, etc. The common voltage Vcom is supplied to the common electrode COM. The pixel electrode PE is coupled with a pixel capacitance Cpix.

The pixel capacitance Cpix is the sum of a liquid crystal capacitance Clc, an auxiliary capacitance Cs, a first coupling capacitance Cgs and a second coupling capacitance C(pix−sl/gl).

$$Cpix=Clc+Cs+Cgs+C(pix\text{-}sl/gl)$$

Here, the liquid crystal capacitance Cls is a capacitance corresponding to an electric field which is diffracted into the liquid crystal layer LQ, and is formed between the pixel electrode PE and the common electrode COM. The pixel capacitance Cpix is a value relying on the voltage value of a signal passing through the pixel electrode. In the calculation of the pixel capacitance Cpix, the auxiliary capacitance Cs, the first coupling capacitance Cgs and the second coupling capacitance C(pix−sl/gl) may be assumed to be values which do not relay on the voltage value of the signal passing through the pixel electrode.

The auxiliary capacitance Cs is formed between the pixel electrode PE and an electrode which is opposed to the pixel electrode PE and is supplied with a voltage Vs. For example, the common electrode COM can be used as the above-described electrode. The first coupling capacitance Cgs is formed between the gate electrode GE and the source electrode SE of the pixel switch SW. The second coupling capacitance C(pix−sl/gl) is the sum of a capacitance formed between the pixel electrode PE and the signal line SL and a capacitance formed between the pixel electrode PE and the scanning line GL.

[Display Driver 3]

Figure 5:
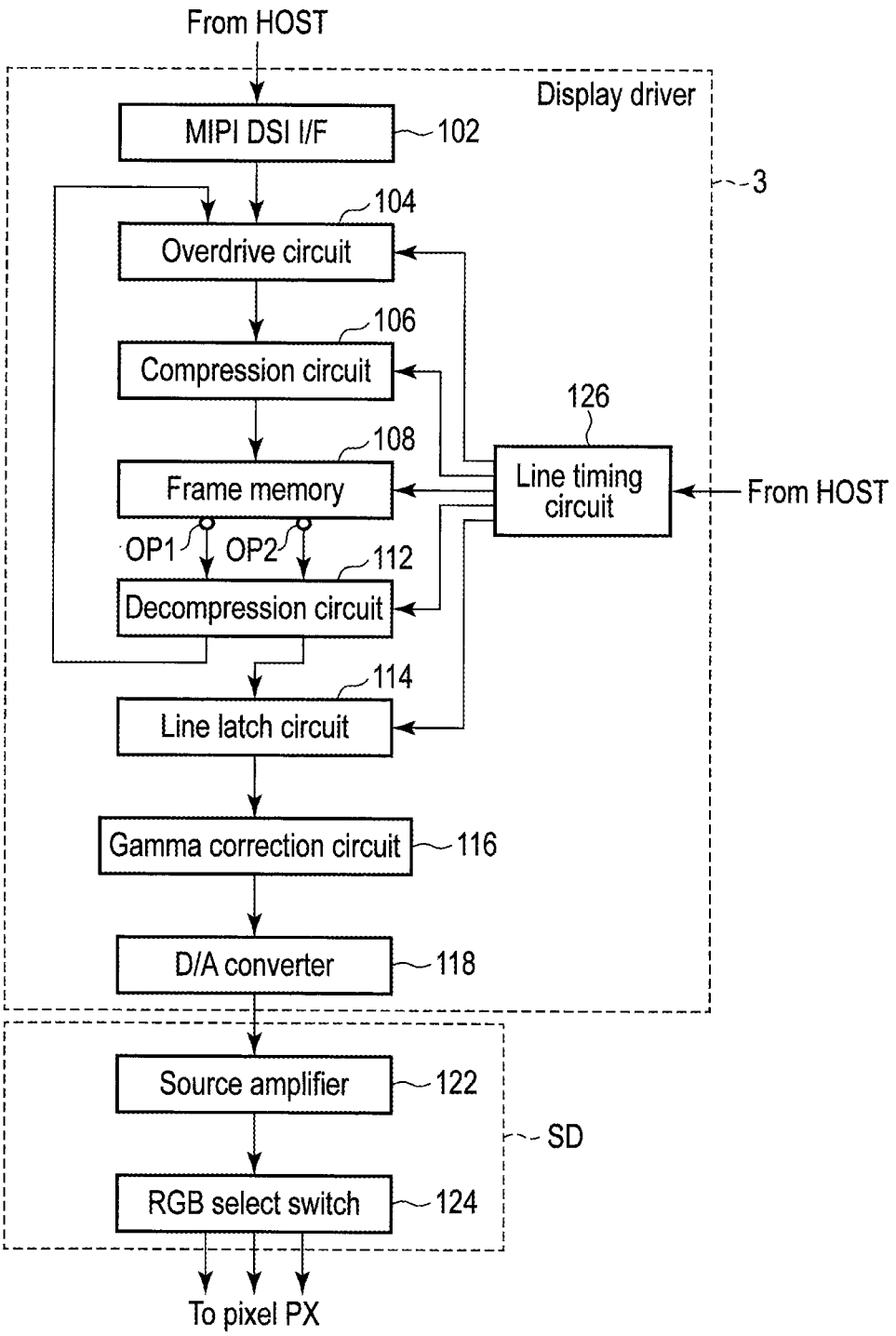
FIG. 5 is a block circuit diagram showing an example of a display driver 3.

FIG. 5 is a block circuit diagram showing an example of the display driver 3.

A video signal supplied from the host device HOST is input to an overdrive circuit 104 via an interface 102. As the interface of the video signal, various interfaces can be used, and for example, the Mobile Industry Processor Interface (MIPI) Display Serial Interface (DSI) (registered trademark) is used. The overdrive circuit 104 corrects (overdrives) the gray level of an input video signal and outputs a post-correction video signal. Gray level correction is intended to make compensation when the pixel is not displayed at a luminance according to a gray level because of the low response speed of liquid crystal. The overdrive circuit 104 makes the gray level lower than the gray level which is determined based on the video signal when the gray level changes downward and makes the gray level higher than the gray level which is determined based on the video signal when the gray level changes upward. The degree of correction of the gray level, that is, the correction amount of the gray level of the video signal of the current frame to be displayed is based on the gray level of the video signal of the current frame and the gray level of the video signal of the previous frame. The video signal of the previous frame may be a pre-correction (pre-overdrive processing) video signal or may be a post-correction (post-overdrive processing) video signal, and the post-correction video signal is used in FIG. 5. When the post-correction video signal is used, a more suitable correction amount can be obtained.

The output of the overdrive circuit 104 is written to a frame memory 108 via a compression circuit 106. The compression circuit 106 reduces the size of the video signal. If the size of the frame memory 108 is sufficient to store the video signal as it is, the compression circuit 106 and a decompression circuit 112 which will be described later are not required. The frame memory 108 composed of a DRAM, an SRAM or the like has one input terminal and two output terminals. The frame memory 108 has the function of storing the video signal of the previous frame to obtain the correction amount of overdrive, and also functions as a frame buffer to write the video signal to the display panel PNL. Therefore, it is unnecessary to provide a frame buffer for display and a memory for overdrive separately.

A video signal output from a first output terminal OP1 of the frame memory 108 is input to the overdrive circuit 104 via the decompression circuit 112, and a video signal output from a second output terminal OP2 is input to a line latch circuit 114 via the decompression circuit 112. Accordingly, the pre-correction video signal of the current frame and the post-correction video signal of the previous frame are input to the overdrive circuit 104. The overdrive circuit 104 will be described in detail with reference to FIG. 9.

A line timing circuit 126 which is supplied with a timing signal such as a synchronization signal from the host device HOST supplies the synchronization signal to the overdrive circuit 104, the compression circuit 106, the frame memory 108, the decompression circuit 112 and the line latch circuit 114.

The post-gray level correction (post-overdrive processing) video signal is output from the frame memory 108 for each of the scanning lines, and the line latch circuit 114 stores the video signals of one or more scanning lines. The output of the line latch circuit 114 is input to a source amplifier 122 via a gamma correction circuit 116 and a D/A converter 118. The source amplifier 122 amplifies the input video signal and supplies it to the pixels PX via an RGB select switch 124 and the signal lines SL. The source amplifier 122 and the RGB select switch (which is referred to also as a multiplexer) 124 constitute the source driver SD shown in FIG. 3. The RGB select switch 124 separates the video signal supplied from the source amplifier 122 in a time-sharing manner into sub-pixel signals of respective colors based on an RGB select signal which is not shown in the drawing, and supplies them to the corresponding sub-pixels. The RGB select switch 124 may be formed on the array substrate AR concurrently in the process of forming the pixel switch SW. The video signal which has not been input to the D/A converter 118 is digital gray level data, and the video signal which has been output from the D/A converter 118 is a voltage signal based on the gray level data which is to be applied to the pixel electrode PE. In the liquid crystal display device, the voltage signal based on the gray level data is applied to the pixel electrode PE with its polarity reversed. The polarity is reversed in the source amplifier 122.

[Overdrive in Impulse Method]

To improve the display performance of a moving image, the impulse method is applied to the liquid crystal display device. In the liquid crystal display device adopting the impulse method, since all the pixels are concurrently lit up but video signals are sequentially written to the pixels in the order of the scanning lines, when the pixels are lit up, the states of the liquid crystal layer corresponding to the pixels vary according to the scanning lines, that is, according to vertical positions. If the frame frequency is low, liquid crystal sufficiently responds regardless of the differences of the vertical positions. However, in the case of VR display, etc., the frame frequency needs to be increased (greater than or equal to 90 Hz, for example, 240 Hz). Therefore, the possibility of variations in the response state of liquid crystal according to the vertical positions remains. Even if overdrive processing is executed, the above-described probability cannot be completely excluded.

Overdrive in the impulse method will be described with reference to FIGS. 6A and 6B. In the impulse method, the video signal is written to each of the pixels of one screen in a state where the backlight unit BL does not emit light, and after the write operation is completed, the backlight unit BL is turned on and the pixels are lit up. Therefore, the impulse method is referred to also as a blink method. As shown in FIG. 6A, the number of scanning lines of one screen is assumed to be 1600, and the video signal is written to each of the pixels PX on a line-by-line basis. The gate drivers GD-R and GD-L sequentially select the scanning lines G from the 1st line to the 1600th line under the control of the display driver 3. The video signal is written to each of the pixels PX of the selected scanning line by the display driver 3 and the source driver SD.

Figure 6B:
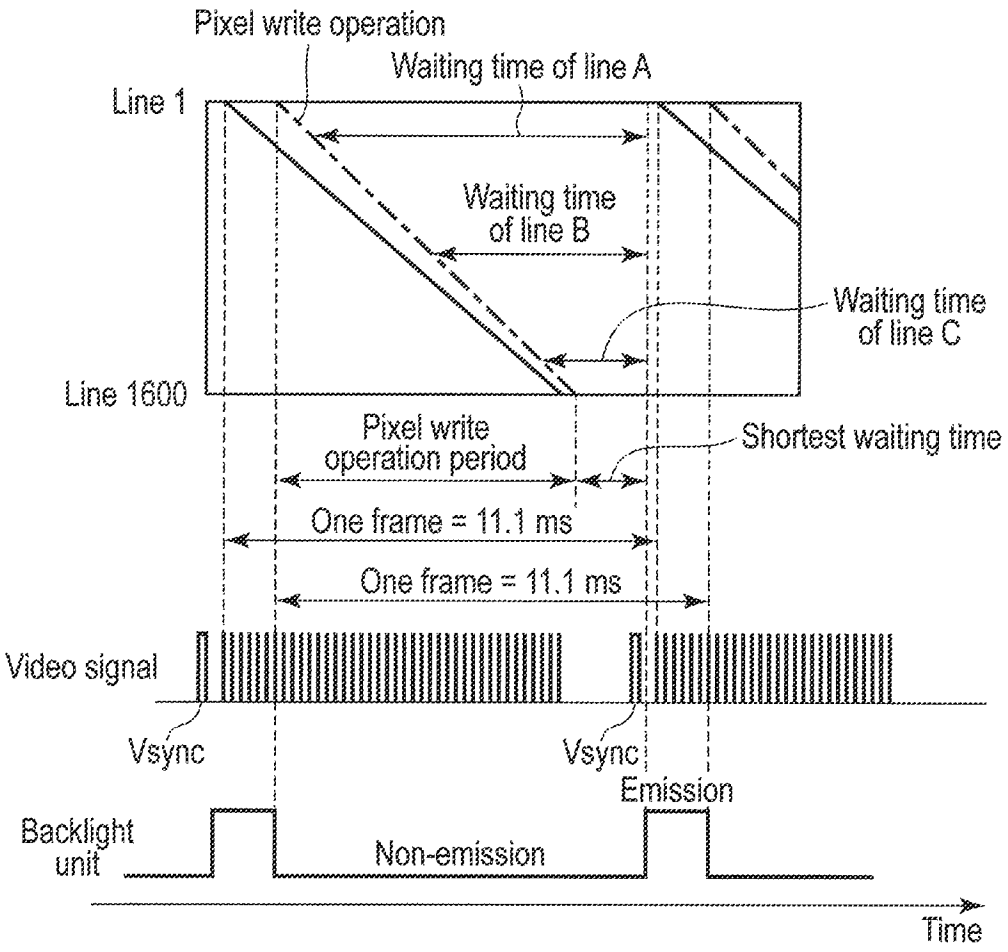
FIGS. 6A and 6B schematically show an example of overdrive in an impulse drive.
Figure 6A:
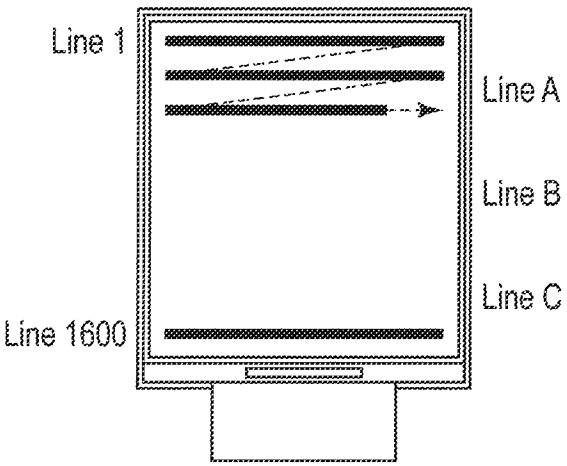

As shown in FIG. 6B, one frame period synchronizes with a vertical synchronization signal Vsync supplied from the host device HOST. The period of the vertical synchronization signal Vsync, that is, one frame period is, for example, 11.1 ms. When a predetermined time passed from the timing of the vertical synchronization signal Vsync, video signals for the pixels of the 1st scanning line are read from the frame memory 108 and are written to the pixels PX via the line latch circuit 114, the gamma correction circuit 116, the D/A converter 118 and the source driver SD. After the video signals are written to the pixels of the 1st scanning line, video signals are written to the pixels of the 2nd scanning line, and similar operations continue until video signals are written to the pixels of the 1600th scanning line.

While video signals are being written, the backlight unit BL is in a non-emission state. When a waiting time passed after video signals are written to the pixels of the last scanning line, that is, the 1600th scanning line of one frame, the backlight unit BL emits light. That is, the backlight unit BL emits light from when the writing of the video signal for the 1600th line ends until when the writing of the video signal for the 1st line of the next frame starts. In this manner, the backlight unit BL has a non-emission period and an emission period in one frame period and blinks on and off.

In the impulse method in which the emission period is short as compared to the hold method in which the backlight unit BL continuously emits light for one frame period, the luminance of the pixel may be reduced. To prevent the luminance of the pixel from being reduced, the emission intensity may be increased by increasing the drive current/voltage. For example, if the emission period is one tenth of one frame period, the luminance reduction of the pixel can be prevented by increasing the drive current/voltage to increase the emission intensity by ten times. Even if the drive current/voltage to the backlight unit BL, for example, an LED, has an upper limit, it is possible to extend the emission period instead of increasing the emission luminance. However, light emission must end before the writing of the next-frame video signal to the panel starts. Further, in consideration of the display performance of a moving image, the emission period is about 30% of one frame period at most. In the case of switching between hold display and impulse display, it is also possible to increase the luminance of the LED at a certain time by making the drive current/voltage supplied to the LED in the impulse display greater than the drive current/voltage supplied to the LED in the hold display.

When video signals are sequentially written from the 1st scanning line, the waiting time after the video signals are written to the 1st scanning line and before the backlight unit BL emits light greatly differs from the waiting time after the video signals are written to the 1600th scanning line and before the backlight unit BL emits light. For example, the time difference is about 5 ms if one frame period is 11.1 ms. In the impulse method in which the backlight unit BL emits light after the video signals are written, if the response speed of liquid crystal is slow, when the backlight unit BL emits light, the response varies between the upper part of the display panel and the lower part of the display panel. Therefore, the luminances of the pixels of the scanning lines in the upper part of the display panel correspond to the luminances according to the gray levels of the video signals, whereas the luminances of the pixels of the scanning lines in the lower part of the display panel do not reach the luminances according to the gray levels of the video signals. Therefore, if the video signals of the 1st line and the video signals of the 1600th line are corrected by the same correction amount by overdrive, the video signals of the 1st line may be overcorrected and the video signals of the 1600th line may be undercorrected. Therefore, the pixels are not displayed at the original luminances.

In the present embodiment, gray level correction is not performed uniformly for the entire frame, but the gray level correction (overdrive processing) is performed based on the position of the scanning line. That is, in the 1st line which is written first and nearby scanning lines, liquid crystal fully responds by the time light emission starts, and the pixels are displayed at desired luminances according to the gray levels of the video signals. But, in the 1600th line which is written last and nearby scanning lines, liquid crystal does not fully respond by the time light emission starts, and therefore the pixels are displayed at luminances significantly lower than the desired luminances according to the gray levels of the video signals. Overdrive is to compensate for the lack of luminance of the pixel resulting from the low response speed of liquid crystal by correcting (increasing) the gray level of the video signal. The correction amount of the gray level of each of the scanning lines varies depending on the waiting time of each of the scanning lines. For example, the correction amounts of the scanning lines in the upper part of the display panel in which the waiting times are long may be small, and the correction amounts of the scanning lines in the lower part of the display panel in which the waiting times are short may be large. Accordingly, when the backlight unit BL emits light, all the pixels are displayed at optimal luminances according to the gray levels of the video signals regardless of the positions of the scanning lines. The correction amount of the gray level of the video signal of each of the pixels is calculated based on the video signal of the current frame to be displayed and the video signal of the previous frame.

As the video signal of the previous frame, a pre-correction video signal may be used but a post-correction video signal is used in the embodiment. If a pre-correction video signal is used, a frame memory other than the frame memory 108 shown in FIG. 5 needs to be provided at the stage prior to the overdrive circuit 104, or the compression circuit 106, the frame memory 108 and the decompression circuit 112 need to be moved to the stage prior to the overdrive circuit 104.

If the video signal of the previous frame used for obtaining the post-overdrive processing gray level is a pre-correction video signal, not only the video signal of the previous frame but also the video signal of the previous frame and the video signal of the frame before the previous frame, that is, the video signals of two or more previous frames may be used.

Figure 7:
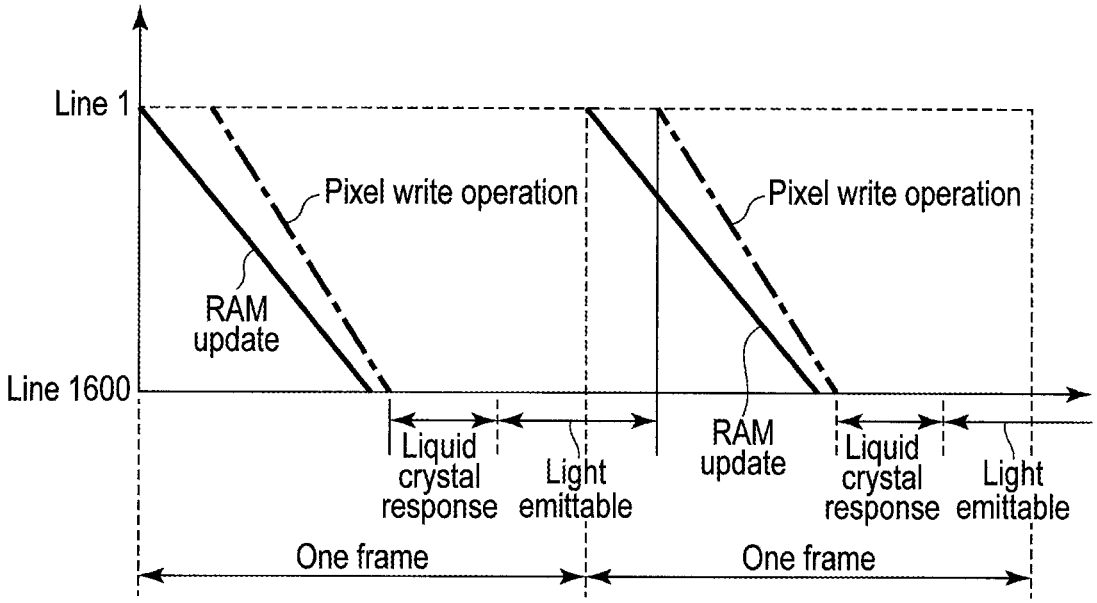
FIG. 7 shows an example of a read/write operation timing of a frame memory.

FIG. 7 shows the read/write operation timing of the frame memory 108. The frame memory 108 can concurrently perform a read operation and a write operation. The post-correction video signal of the previous frame stored in the frame memory 108 is read and supplied to the overdrive circuit 104 via the decompression circuit 112. The overdrive circuit 104 corrects the gray level of the video signal of the current frame supplied from the interface 102 based on the gray level of the post-correction video signal of the previous frame and the gray level of the current frame, and writes the post-correction video signal of the current frame to the frame memory 108 via the compression circuit 106. The read operation of the post-correction video signal of the previous frame, and the write operation of the post-correction video signal of the current frame performed concurrently with the read operation are shown by a solid line in FIG. 7. This operation is referred to also as RAM update. The RAM update starts at the beginning of one frame period.

When the post-correction video signal of the current frame is written to the frame memory 108, the pixel write operation shown by a dashed-dotted line in FIG. 7 is started. The pixel write operation is an operation during the pixel write period shown in FIG. 6. In the pixel write period, the post-correction video signal of the current frame is read from the frame memory 108 and is written to the pixels PX via the decompression circuit 112, the line latch circuit 114, the gamma correction circuit 116, the D/A converter 118, the source amplifier 122 and the select switch 124. The backlight unit BL can emit light during a period from when the pixel write operation of the 1600th line ends (a liquid crystal response period from when the video signal is written to the pixels PX until when the luminance of liquid crystal reaches the luminance according to the video signal ends) until when the pixel write operation of the next frame starts. The RAM update speed (the slope of the solid line of FIG. 7) is determined by the data transfer speed of the video signal input from the host device HOST. The pixel write operation is performed after the RAM update. In the case of extending the emission period of the backlight as much as possible to maintain the luminance of the pixel at or above a certain level of luminance, the pixel write operation should be performed as fast as possible (the slope of the dashed-dotted line of FIG. 7 should be as steep as possible).

Figure 8:
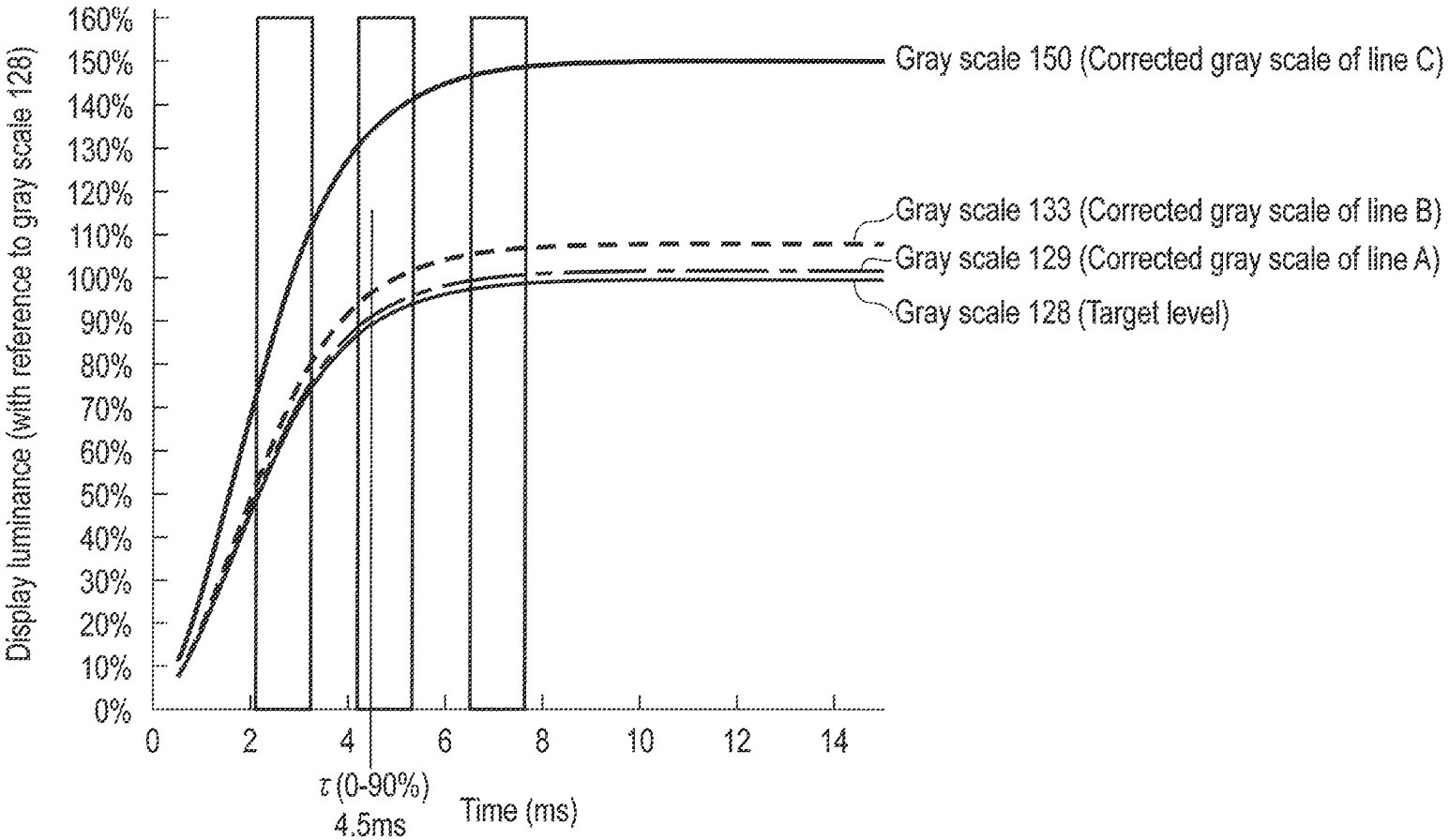
FIG. 8 shows an example of a difference of a gray level correction amount of each of horizontal lines.

FIG. 8 shows the response characteristics in the case of changing liquid crystal from black (gray level 0) to a halftone (for example, gray level 128 in the case of an 8-bit video signal). The horizontal axis indicates time since the video signal is written to the pixel, and the vertical axis indicates the display luminance of the pixel. The three vertically-long rectangles schematically show the emission periods of the backlight unit BL. If a target gray level is gray level 128, the gray level of the video signal in line A located on the upper side of the screen is corrected to "129" which is marginally greater than the target gray level, the gray level of the video signal in line B located at the center of the screen is corrected to "133" which is slightly greater than the target gray level, and the gray level of the video signal in line C located on the lower part of the screen is corrected to "150" which is significantly greater than the target gray level. In the case of the frame rate shown in FIG. 6, the time from when the pixel write operation ends until when the backlight unit BL is turned on is about 7 ms in line A, about 4.75 ms in line B, and about 2.25 ms in line C. As shown in FIG. 8, when the backlight unit BL is turned on, the target gray level, that is, gray level 128 will be the luminance of 100% response in all the lines with overdrive correction. As a matter of course, the overdrive intensity may be adjusted by setting a gray level difference of less-perfect response, that is, 90% to 100% response instead of a gray level difference which perfectly matches with 100% response. Further, in the case of line A, if the gray level difference is small, the original gray level may be applied without any gray level correction.

If the speed of the RAM update and the speed of the pixel write operation shown in FIG. 7 cannot be increased and the light emittable period cannot be set freely, the gray level may be corrected to increase the amount of correction (the difference between the target gray level (128) and the gray level (129, 133, 150, etc.) of the post-correction video signal which is actually written to the pixels. Therefore, the initial rise of the curve of FIG. 8 may be made steep such that the display luminance of the pixel will be 90% of the display luminance corresponding to the target gray level in all of line A, line B and line C at the beginning of light emission.

[Overdrive Circuit 104]

Figure 9:
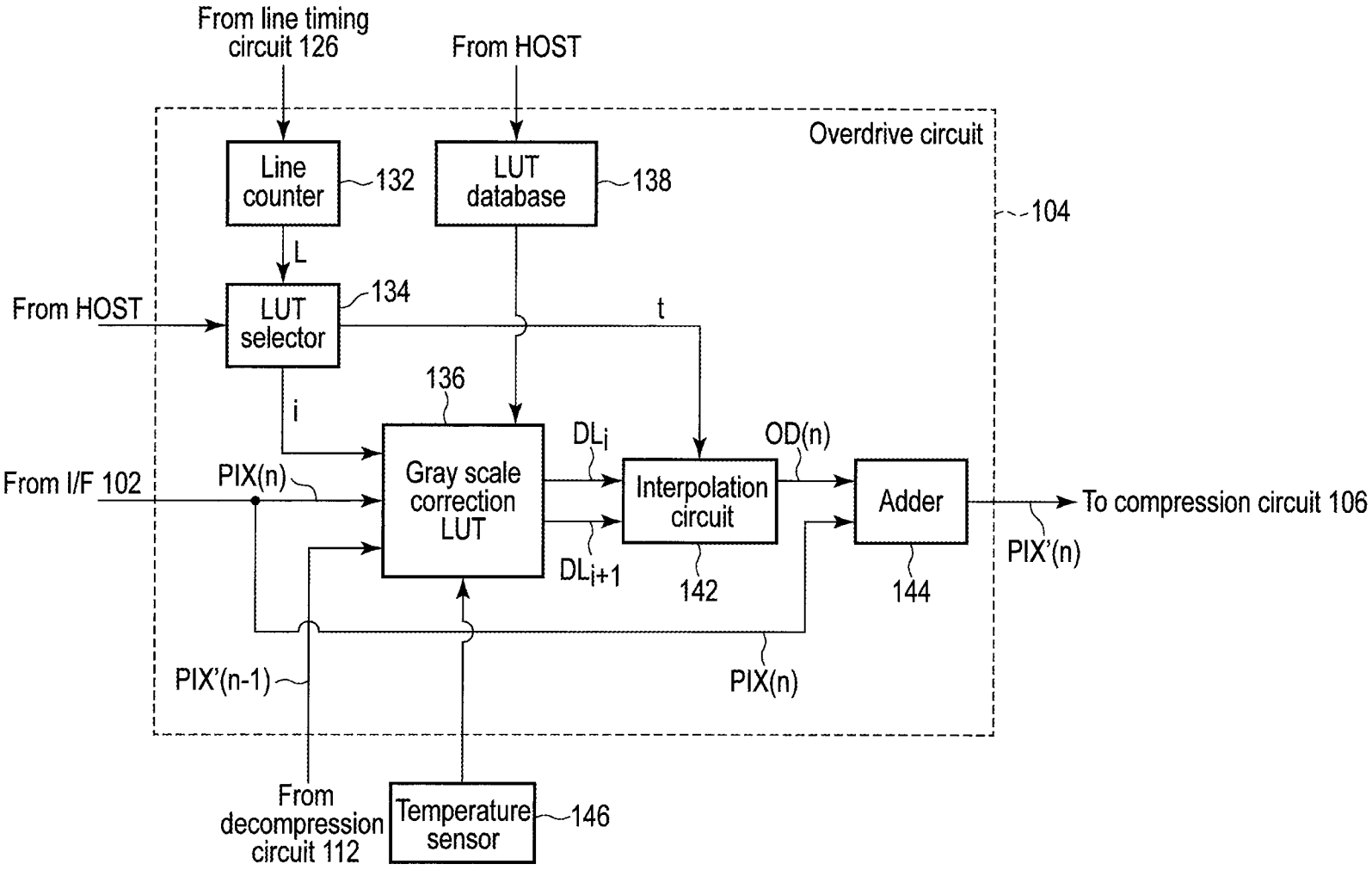
FIG. 9 is a block circuit diagram showing an example of an overdrive circuit 140.

FIG. 9 is a block circuit diagram showing an example of the overdrive circuit 104 in the display driver 3. The overdrive circuit 104 includes a line counter 132, a look-up table (LUT) selector 134, a gray level correction LUT 136, an LUT database 138, an interpolation circuit 142 and an adder 144. A video signal PIX(n) of the current frame supplied via the interface 102 is supplied to the gray level correction LUT 136. A post-correction video signal PIX'(n−1) of the previous frame output from the frame memory 108 is also supplied to the gray level correction LUT 136 via the decompression circuit 112. The gray level correction LUT 136 is composed of a RAM, etc., and the LUT database 138 is composed of a flash memory, etc. The LUT database 138 stores data for a plurality of LUTs. The plurality of LUTs correspond to different temperatures. The LUT database 138 sets LUT data to the gray level correction LUT 136 when the power is turned on. When temperature changes, the LUT database 138 rewrites the LUT data of the gray level correction LUT 136 to the LUT data corresponding to the changed temperature by an instruction from the host device HOST.

The synchronization signal supplied from the line timing circuit 126 is counted in the line counter 132. The line counter 132 outputs, to the LUT selector 134, a line signal L (L=1 to 1600) indicating the number of the scanning line corresponding to the video signal input to the gray level correction LUT 136. The degree of correction of the gray level of the video signal PIX(n) of the current frame for overdrive, that is, the post-correction gray level of the video signal PIX(n) of the current frame can be calculated for each of the scanning lines based on the gray level of the video signal PIX(n) of the current frame, the gray level of the post-correction video signal PIX'(n−1) of the previous frame, and the data on the response speed of liquid crystal. However, a look-up table which stores a post-correction gray level calculated in advance is used in the embodiment. Since the overdrive correction amount varies depending on the position of the scanning line, the look-up table is prepared for each of the scanning lines. However, if the number of scanning lines increases, the look-up table cannot be prepared for each of the scanning lines because of a limitation on the memory size, etc. Therefore, regarding some scanning lines, for example, five scanning lines $LP_0$, $LP_1$, $LP_2$, $LP_3$ and $LP_4$, look-up table data $LUT_0$, $LUT_1$, $LUT_2$, $LUT_3$ and $LUT_4$ may be prepared, and regarding the other scanning lines, interpolation calculation is performed by two (or three or more) look-up table data LUT, and the post-correction gray level may be thereby obtained. The five look-up table data $LUT_0$, $LUT_1$, $LUT_2$, $LUT_3$ and $LUT_4$ are set to the gray level correction LUT 136 from the LUT database 138. For example, the look-up table data $LUT_0$ and $LUT_1$ of the scanning lines $LP_0$ and $LP_1$ are shown in FIG. 10 and FIG. 11. The look-up table data $LUT_2$ to $LUT_4$ of the scanning lines $LP_2$ to $LP_4$ take similar forms.

The five scanning lines may be selected by dividing all the scanning lines evenly. For example, $LP_0$=1, $LP_1$=400, $LP_2$=800, $LP_3$=1200 and $LP_4$=1600. FIG. 10 is the look-up table data $LUT_0$ of the 1st scanning line ($LP_0$=1), and FIG. 11 is the look-up table data $LUT_1$ of the 400th scanning line ($LP_1$=400). Alternatively, the five scanning lines may be selected by dividing all the scanning lines unevenly. Since the waiting times of the scanning lines located on the lower side of the screen are short, the differences between the predetermined luminance and the luminances attainable at the time of light emission are large, and the gray levels are greatly corrected. Therefore, the correction amounts of these scanning lines have large impacts on the image quality of the entire screen. Consequently, to perform overdrive more precisely, the scanning lines may be selected sparsely on the upper side of the screen and may be selected densely on the lower side of the screen. For example, $LP_0$=1, $LP_1$=800, $LP_2$=1200, $LP_3$=1400 and $LP_4$=1600. The number of scanning lines to be selected is not limited to five, and more scanning lines may be selected.

As shown in FIG. 10 and FIG. 11, if the video signal has an 8-bit gray level (256-gray level), the look-up table data $LUT_0$, $LUT_1$, $LUT_2$, $LUT_3$ and $LUT_4$ store the gray levels of the post-correction video signal of the current frame with respect to all the gray levels (256 gray levels) of the pre-correction video signal of the current frame and all the gray levels (256 gray levels) of the post-correction video signal of the previous frame. For the sake of saving the memory of the gray level correction LUT 136, etc., the table may not be prepared for all gray levels but may be prepared for some typical gray levels. For example, the table may be prepared only by the specific numbers described in FIG. 10 and FIG. 11, namely, 0, 32, . . . , 255, that is, only by eight gray levels. Regarding the gray levels which do not exist in the table, interpolation calculation is performed. The table may not be prepared for evenly-distributed gray levels but may be prepared for unevenly-distributed gray levels. For example, the table may be prepared densely for high gray levels and may be prepared for those of low gray levels which are selected sparsely.

FIG. 10 and FIG. 11 show examples of correcting the video signal of the 8-bit gray level with 8 bits, but the correction amount may use the number of bits less than the number of gray levels of the video signal, for example, 6 bits. In the case of using the 6-bit post-correction video signal by cutting off the lower 2 bits of the 8-bit post-correction video signal, the size of the look-up table data LUT can be reduced to one-sixteenth of the initial size from the size of 256×256 to the size of 64×64. Even if the lower 2 bits of the 8-bit post-correction video signal is cut off, no problem arises in practice.

FIG. 10 and FIG. 11 store a post-correction gray level, but may store a gray level correction value which is a difference between the gray level of the pre-correction video signal of the current frame and the gray level of the post-correction video signal of the current frame. FIG. 12 shows a table which stores gray level difference values for FIG. 10. In the case of storing the gray level difference value, as compared to the case of storing the post-correction gray level itself, the number of bits of table data can be reduced, and the memory of the gray level correction LUT 136 can be saved. In the case of storing the gray level difference value, the gray level difference value read from the look-up table is added to the video signal of the pre-correction current frame, and the gray level value of the post-correction signal of the current frame is thereby obtained. FIG. 9 shows an example of storing the gray level difference value in the gray level correction LUT 136. FIG. 12 stores gray level correction values (difference values) with respect to all the gray levels (256 gray levels) of the pre-correction video signal of the current frame and all the gray levels (256 gray levels) of the post-correction video signal of the previous frame. But, FIG. 12 may not store gray level correction values (difference values) for all gray levels but may only store gray level correction values for some typical gray levels.

Figure 13:
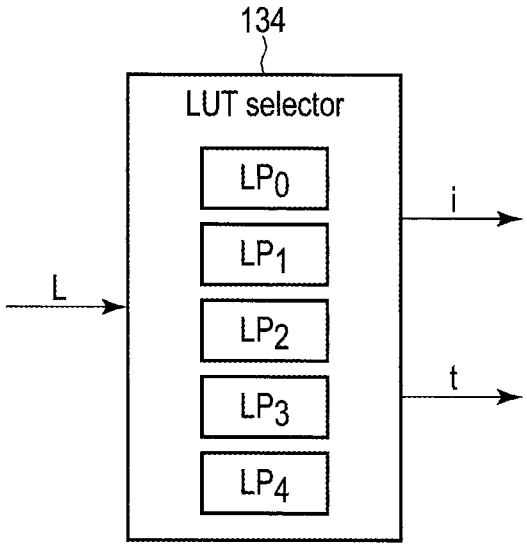
FIG. 13 shows an example of an LUT selector 134.

The LUT selector 134 inputs the line signal L and outputs a line position signal i and an interpolation coefficient t as shown in FIG. 13. The LUT selector 134 compares the line signal L with the scanning lines $LP_0$, $LP_1$, $LP_2$, $LP_3$ and $LP_4$ and determines the value of the line position signal i as follows. If the line signal L is greater than or equal to the scanning line $LP_0$ and is less than the scanning line $LP_1$ ($LP_0 \leq L < LP_1$), the line position signal i is 0. If the line signal L is greater than or equal to the scanning line $LP_1$ and is less than the scanning line $LP_2$ ($LP_1 \leq L < LP_2$), the line position signal i is 1. If the line signal L is greater than or equal to the scanning line $LP_2$ and is less than the scanning line $LP_3$ ($LP_2 \leq L < LP_3$), the line position signal i is 2. If the line signal L is greater than or equal to the scanning line $LP_3$ and is less than or equal to the scanning line $LP_4$ ($LP_3 \leq L \leq LP_4$), the line position signal i is 3. That is, the line position signal i indicates two of the five scanning lines $LP_0$, $LP_1$, $LP_2$, $LP_3$ and $LP_4$ between which the scanning line exists. The line position signal i is supplied to the gray level correction LUT 136. The interpolation coefficient t is a ratio indicating the closeness of the line signal L to the scanning line $LP_{i+1}$ as compared to the scanning line $LP_i$, and the interpolation coefficient t is 0 if the line signal L coincides with the scanning line $LP_i$ and the interpolation coefficient t is 1 if the line signal L coincides with the scanning line $LP_{i+1}$. The interpolation coefficient t is supplied to the interpolation circuit 142.

The gray level correction LUT 136 selects two look-up table data $LUT_i$ and $LUT_{i+1}$ from the five look-up table data $LUT_0$, $LUT_1$, $LUT_2$, $LUT_3$ and $LUT_4$ according to the line position signal i, and reads gray level correction values $DL_i$ and $DL_{i+1}$ respectively from the selected two look-up table data $LUT_i$ and $LUT_{i+1}$ and supplies them to the interpolation circuit 142. For example, if the line position signal i is 0, the line signal L is greater than or equal to the scanning line $LP_0$ and is less than the scanning line $LP_1$ ($LP_0 \leq L < LP_1$), and therefore the gray level correction values $DL_i$ and $DL_{i+1}$ are read respectively from the look-up table data $LUT_0$ and $LUT_1$ and are supplied to the interpolation circuit 142.

In the case of the first frame after the power is turned on, no frame exists before the first frame. The gray level correction LUT 136 will be referred based on a predetermined gray level according to a specification of a display device, for example, black (gray level 0) or a halftone (gray level 128).

The response speed of liquid crystal relies on the temperature of the panel. For example, the response speed of liquid crystal increases as the temperature increases. Therefore, the correction amount of overdrive varies depending on the temperature. A temperature sensor 146 is provided inside the liquid crystal display panel or outside the liquid crystal display device, the temperature of the display panel PNL is measured, and the result of measurement is supplied to the gray level correction LUT 136. The gray level correction LUT 136 multiplies the gray level correction values $DL_i$ and $DL_{i+1}$ read respectively from two look-up table data $LUT_i$ and $LUT_{i+1}$ by a temperature coefficient according to the temperature (the coefficient value decreases as the temperature increases), and outputs the multiplied gray level correction values $DL_i$ and $DL_{i+1}$ to the interpolation circuit 142. Temperature correction is thereby performed.

The temperature correction may not be performed by calculation but may be performed by further preparing look-up table data which stores the gray level correction value of each of the scanning lines for each of some typical temperatures in the LUT database 138 and setting look-up table data according to temperatures from the LUT database 138 to the gray level correction LUT 136. Regarding a temperature other than the temperatures whose look-up tables are prepared, as is the case with the above-described look-up table of each of the scanning lines, the post-correction gray level of the temperature may be interpolated by post-correction gray levels read from two look-up tables of close temperatures.

The interpolation circuit 142 obtains a post-correction gray level OD(n) of the current frame as follows according to the gray level correction values $DL_i$ and $DL_{i+1}$ and the interpolation coefficient t.

$$OD = DL_i \times (1-t) + DL_{i+1} \times t$$

The output OD(n) of the interpolation circuit 142 is added to the video signal PIX(n) of the current frame by the adder 144, and the post-gray level correction video signal PIX'(n) of the current frame is obtained. The video signal PIX'(n) is supplied to the frame memory 108 via the compression circuit 106 as the output of the overdrive circuit 104. If the gray level correction LUT 136 does not store the gray level difference values shown in FIG. 12 but stores the post-correction gray levels shown in FIG. 10 and FIG. 11, the adder 144 is not required, and the output of the interpolation circuit 142 is supplied to the frame memory 108 via the compression circuit 106.

The interpolation circuit 142 can selectively set the output to 0 according to the user setting. That is, it is possible to set the overdrive circuit 104 not to perform overdrive correction. Overdrive may not be preferable in some cases, and whether or not to execute overdrive can be determined by the user. For example, an overdrive on/off signal is supplied from the host device HOST to the interpolation circuit 142. Alternatively, since overdrive according to the embodiment requires temperature compensation, if the temperature sensor 146 is not provided, the output of the interpolation circuit 142 is set to 0. If the adder 144 is not required as described above, a selector which selects the output of the interpolation circuit 142 and the video signal PIX(n) of the current frame may be provided in place of the adder 144, and if overdrive is not to be executed, the video signal PIX(n) of the current frame may be selected.

The output of the overdrive circuit 104 is written to the frame memory 108 as the post-correction video signal PIX'(n) of the current frame via the compression circuit 106. The post-correction video signal PIX'(n) of the current frame of each of the scanning lines read from the frame memory 108 is supplied to the pixels PX via the line latch circuit 114, the gamma correction circuit 116, the D/A converter 118, and further the source driver SD amplifier 122 and the signal lines SL. In the next frame, the post-correction video signal PIX'(n−1) of the previous frame of each of the scanning lines read form the frame memory 108 is supplied to the gray level correction LUT 136, and the pre-correction video signal PIX(n) of the current frame is subjected to overdrive correction.

According to the embodiment, in the impulse method in which the emission period and the non-emission period exist in one frame period, the waiting time after the video signals are written to the pixels and before the backlight unit BL emits light varies depending on the scanning line. The overdrive amount is changed depending on the scanning line in consideration of the variance of the state of liquid crystal among the scanning lines at the time of light emission. Therefore, overdrive can be performed appropriately even in the impulse method. If an overdrive amount is determined by a look-up table, a look-up table is prepared for each of the scanning lines. To reduce the size of the look-up table, post-correction gray levels may not be stored for all gray levels, but post-correction gray levels may be stored for some typical gray levels. Similarly, to reduce the size of the look-up table, post-correction gray levels may not be stored, but gray level correction values may be stored and a gray level correction value read from the look-up table may be added to the video signal to obtain the post-correction gray levels. To perform temperature compensation, look-up tables may be provided for each of the scanning lines and for each of the temperatures of the panel.

As the host device HOST selectively sets the output of the interpolation circuit 142 to 0, whether or not to execute gray level interpolation can be controlled. Therefore, for example, overdrive correction may not be performed when a smartphone is normally used, and overdrive correction may be performed when a smartphone is loaded into a head-mounted display and performs VR display.

The performance indexes of the display device are a blurred edge time (BET) value which is time taken by the light intensity of an edge blur curve to increase from 10% to 90%, and a moving picture response time (MPRT) value which is obtained by averaging 42 BET values which are combinations among seven gray levels as an index including a middle gray level. These indexes are improved in the display device of the embodiment.

[Modification]

Figure 14:
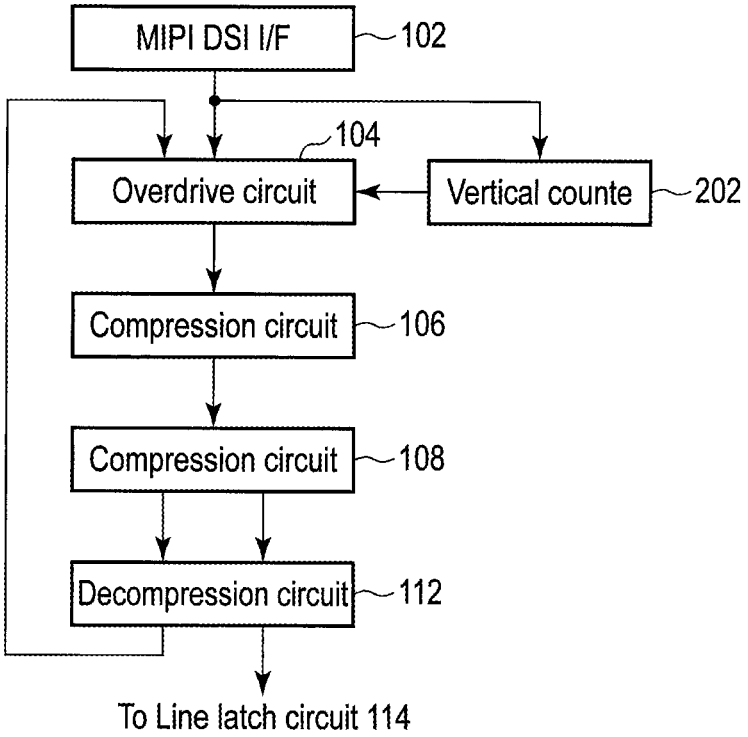
FIG. 14 is a block circuit diagram showing a modified example of the display driver 3.

In the above description, the position of the scanning line is detected based on the horizontal synchronization signal supplied from the host device HOST. A modification related to the detection of the position of the scanning line will be described below. FIG. 14 is a block circuit diagram of the main units of the first modification of the display driver 3. Since one image is composed of a plurality of pixels arranged in a matrix, the video signal is composed of a plurality of pixel signals arranged in a predetermined order. For example, as shown in FIG. 6A, the pixel signals are arranged such that the video signals are written from the uppermost scanning line to the lowermost scanning line and are written from the leftmost pixel to the rightmost pixel in each of the scanning lines. Therefore, as shown in FIG. 14, the video signal supplied from the interface 102 is input to the overdrive circuit 104 and is also input to a vertical counter 202. The vertical counter 202 recognizes the scanning line in which the pixel is located by counting the pixel signal in the video signal. The output of the vertical counter 202 is supplied to the line counter 132 of FIG. 9 instead of the horizontal synchronization signal.

Figure 15:
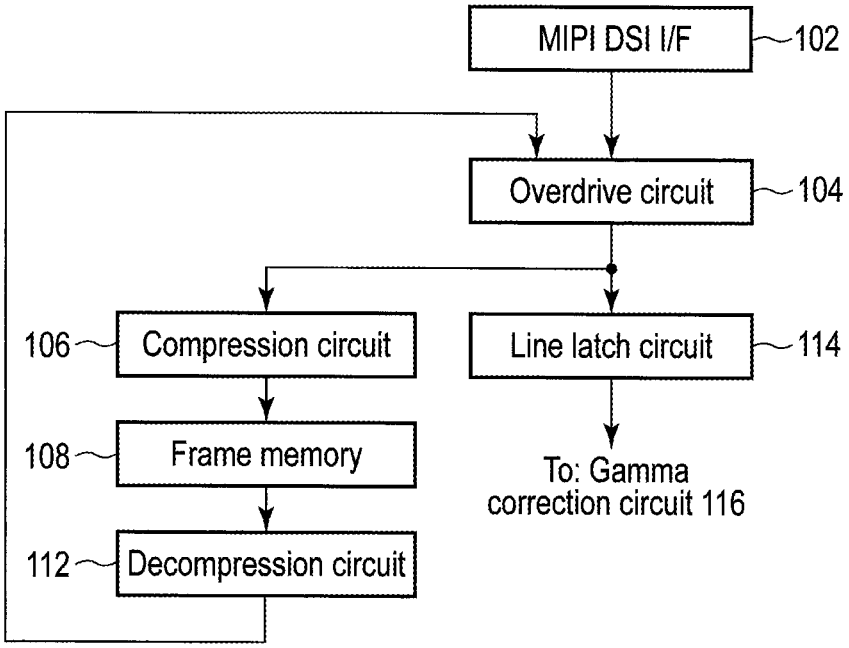
FIG. 15 is a block circuit diagram showing another modified example of the display driver 3.

FIG. 15 is a block circuit diagram showing the second modification of the display driver 3. FIG. 5 shows an example where the video signal of the previous frame and the video signal to be written to the display panel PNL are written to the same frame memory 108 for overdrive correction. Contrary to FIG. 5, FIG. 15 shows an example where the video signal to be written to the display panel PNL is not stored in the frame memory 108. The post-gray level correction video signal output from the overdrive circuit 104 is written to the frame memory 108 via the compression circuit 106. The post-gray level correction video signal output from the frame memory 108 is supplied to the overdrive circuit 104 via the decompression circuit 112. On the other hand, the post-gray level correction video signal output from the overdrive circuit 104 is written to the line latch circuit 114. If the line latch circuit 114 has a capacity to store video signals of a plurality of lines, the video signal to be written to the display panel PNL may not be stored in the frame memory 108.

In the above description, the overdrive circuit 104 which changes the gray level of the video signal more drastically than the original gray level corresponding to the desired display luminance of the video signal is provided in the display driver 3 to which the video signal is supplied from the host device. The overdrive circuit 104 of FIG. 5 may be provided in the host device instead. In that case, to determine the gray level correction value, the post-gray level correction video signal will be supplied to the host device.

Since the processing of the present embodiment can be implemented by the computer program, advantages similar to the advantages of the present embodiment can easily be obtained by installing the computer program in a computer via a computer-readable storage medium in which the computer program is stored and by merely executing the computer program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic device comprising:

a correction circuit, wherein pixels comprise a first row of pixels and a second row of pixels, and if a gray level of a video signal for the first row of pixels and a gray level of a video signal for the second row of pixels are equal to each other, a gray level of a post-correction video signal for the first row of pixels and a gray level of a post-correction video signal for the second pixels are different from each other.

2. The electronic device of claim 1, wherein the first row is prior to the second row in a frame.

3. The electronic device of claim 1, wherein if the gray level of the video signal for the first row of pixels and the gray level of the video signal for the second row of pixels are equal to each other for two frame periods, the gray level of the post-correction video signal for the first row of pixels and the gray level of the post-correction video signal for the second row of pixels are different from each other.

4. The electronic device of claim 1, wherein the first row is prior to the second row in a frame.

5. The electronic device of claim 1, wherein the correction circuit comprises a memory configured to store the post-correction video signal, and the correction circuit is configured to correct the gray level of the video signal based on the post-correction video signal stored in the memory.

6. The electronic device of claim 1, wherein the electronic device is configured to receive the video signal from a host device, and the correction circuit is configured to correct the gray level of the video signal from the host device.

7. The electronic device of claim 1, further comprising a video signal source configured to generate the video signal, wherein the correction circuit is configured to correct the gray level of the video signal generated from the video signal source.

8. The electronic device of claim 1, wherein the correction circuit is configured to correct the gray level of the video signal according to temperature.

9. The electronic device of claim 1, wherein the correction circuit comprises a plurality of lookup tables according to positions of different rows, and the look-up tables show the gray level of the post-correction video signal with respect to a gray level of a video signal of a first frame and a gray level of a video signal of a second frame.

* * * * *